United States Patent [19]

Nusbaum

[11] Patent Number: 4,896,864

[45] Date of Patent: Jan. 30, 1990

[54] SAFETY BARRIER

[75] Inventor: Arthur Nusbaum, Fort Lee, N.J.

[73] Assignees: Robert Nusbaum; Howard Nusbaum, both of New York, N.Y.; Barbara Selick, Teaneck, N.J.

[21] Appl. No.: 197,101

[22] Filed: May 20, 1988

[51] Int. Cl.[4] ..... A01G 17/06

[52] U.S. Cl. ..... 256/23; 256/DIG. 6; 256/1

[58] Field of Search ..... 256/19, 1, 23, DIG. 6

[56] References Cited

U.S. PATENT DOCUMENTS

| | | | |
|---|---|---|---|
| 3,589,682 | 6/1971 | Dickey . | |
| 3,822,850 | 7/1974 | Elias . | |
| 3,848,854 | 11/1974 | De Barbieri . | |
| 3,920,220 | 11/1975 | Elias . | |
| 3,920,221 | 11/1975 | Berry et al. . | |
| 3,946,992 | 3/1976 | Elias . | |
| 3,995,833 | 12/1976 | McLaughlin et al. . | |
| 4,003,553 | 1/1977 | Morris . | |
| 4,236,698 | 12/1980 | Compte . | |
| 4,515,349 | 5/1985 | Groves | 256/1 |
| 4,605,204 | 8/1986 | Schmanski et al. | 256/13.1 X |

OTHER PUBLICATIONS

Advertisement for Vertical Net Debris Containment System of Sinco Inc.

Strong Man, Safety Barrier Fencing.

*Primary Examiner*—Andrew V. Kundrat

*Attorney, Agent, or Firm*—Jacobs & Jacobs

[57] ABSTRACT

A safety barrier assembly for a building under construction comprises a continuous barrier in sheet form having a height several feet above the floor and a toeboard secured to a cable spaced only a few inches from the floor, the free end of the toeboard lying on but being unsecured to the floor.

26 Claims, 2 Drawing Sheets

FIG. 1
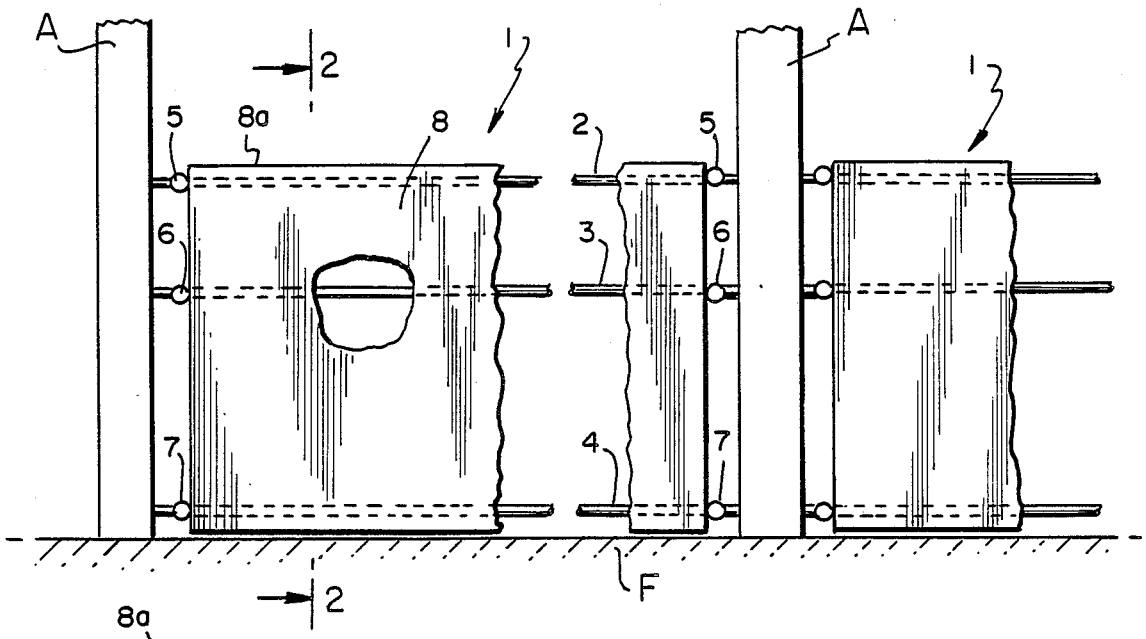
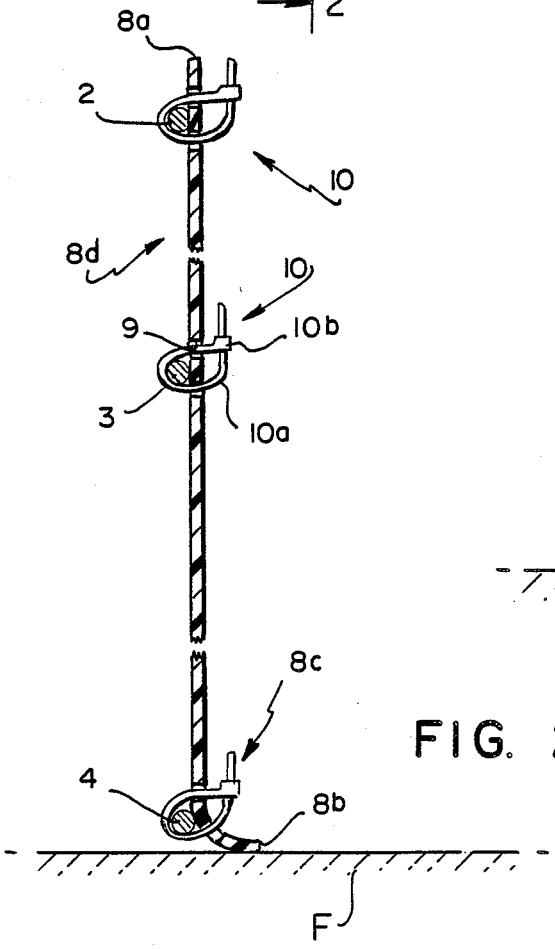
FIG. 2
FIG. 5
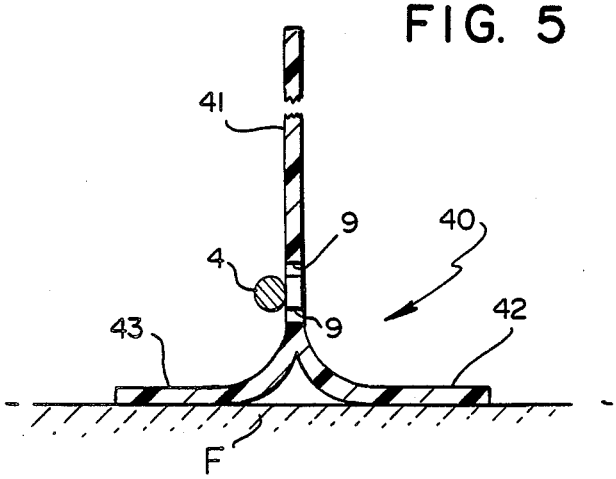

SAFETY BARRIER

The present invention relates to a safety barrier assembly for a building under construction. More particularly, the present invention relates to a safety barrier assembly for guarding open-sided floors and roofs of a building under construction to prevent employees or materials from falling from the building.

During the construction of a building it is necessary to provide means for preventing construction workers from falling from the building and injuring themselves, sometimes fatally, and for preventing materials from falling from the building thereby injuring people on the ground. OSHA has established construction standards for guarding open-sided floors and roofs, including erection of a "standard railing", which comprises a top rail, intermediate rail, toeboard and posts, to enclose such open spaces. The top rail is required to have a vertical height of approximately 42 inches from the upper surface of the top rail to the floor, platform, runway or the like being protected. The intermediate rail is specified to be halfway between the top rail and the floor, etc., while the toeboard is required to be at least 4 inches in vertical height from its top edge to the level of the floor, platform, etc. In addition, the toeboard must be securely fastened in place and must be flush with the floor such that not more than a ¼-inch clearance exists between the toeboard and the floor. An assembly so constructed is referred to as a "standard railing".

No doubt the standard railing has contributed to the safety of construction workers and persons passing on the street adjacent the building under construction. However, not all materials that can fall from a building are stopped by the toeboard. Any material attaining a vertical height greater than the toeboard will pass over the toeboard and through the open spaces between the cables or between the lower cable and the toeboard. In addition, the requirement that the toeboard be secured to the floor means that after the toeboard has served its purpose, it must be removed, thereby adding to the labor costs. Moreover, if work has to be done beyond the perimeter of the floor, the toeboard can and often does interfere with the worker in accomplishing his or her task.

The present invention provides a safety barrier assembly for a building under construction, which comprises a barrier in sheet form that will provide a continuous barrier to a height several feet above the floor. In addition, the safety barrier assembly according to the present invention provides a toeboard that will safely prevent materials from sliding along the floor of the building and then off the building, wherein the toeboard is secured to a cable only a few inches from the floor, the free end of the toeboard lying on but being unsecured to the floor. The toeboard can be quickly releasably detached from the cable to permit dismantling of the safety barrier assembly and/or to enable a worker to perform tasks unimpeded by a toeboard fixedly secured to the floor.

In particular, the present invention provides a safety barrier assembly for a building under construction, which comprises upper and lower cables supported substantially horizontally by cable support means along at least a portion of the outer perimeter of the building floor, the lower cable being only a few inches above the building floor An elongated sheet means having opposed longitudinally extending first and second edges, a main body portion extending from the first edge toward the second edge, and a stiff longitudinally extending bottom portion extending from the main body portion toward and terminating in the second edge, is supported vertically by the cables with the main body portion being secured to the upper cable and the stiff bottom portion being secured to the lower cable. The stiff bottom portion performs the function of the toeboard, the stiff bottom portion lying on but being unsecured to the building floor with the second edge of the elongated sheet means being positioned inwardly of the lower cable. In order to meet the constructions standards set forth in OSHA, the assembly according to the present invention has a strength sufficient to withstand a load of 200 pounds applied in any direction with a minimum of deflection.

As thus supported by the cables, the elongated sheet means provides a continuous barrier from the floor of the building to a predetermined height above the floor. Releasably secured to the lower cable, preferably by quick release fasteners, is the stiff bottom portion or toeboard, whereby the stiff bottom portion can be quickly detached from the lower cable and removed from the floor to permit a worker to gain access to the space that would otherwise have been blocked by the stiff bottom portion.

The present invention is illustrated in terms of its preferred embodiments in the accompanying drawings, in which FIG. 1 is a side elevational view of the safety barrier assembly of the present invention enclosing the open side of a floor of a building under construction, as viewed from the building looking out;

FIG. 2 is a view in section taken along lines 2—2 in FIG. 1;

FIG. 5 is a view similar to FIG. 4 of another embodiment of the present invention;

Figure 3:
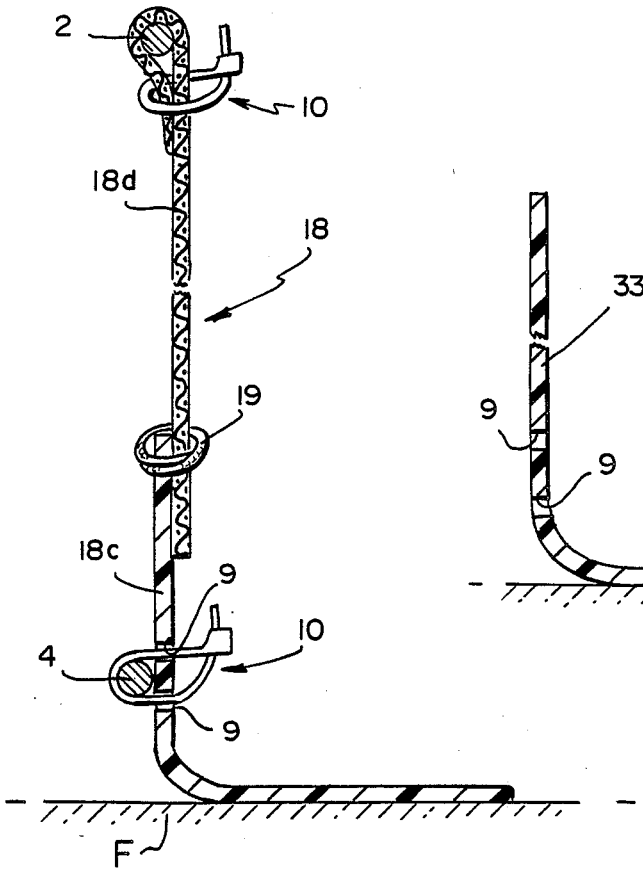
FIG. 3 is a view similar to FIG. 2 of another embodiment of the invention.

Referring to FIG. 1, the safety barrier assembly 1 of the present invention comprises upper cable 2, intermediate cable 3 and lower cable 4 supported horizontally between cable supports 5, 6, 7, respectively, which are in turn secured to the columns A of the building. The cable supports 5, 6, 7 may be any suitable conventional cable supports, such as eye bolts, which are secured to columns A by any suitable conventional means. For example, if columns A are concrete columns, then the eye bolts will be screwed into plugs which are in turn inserted into the concrete column. If columns A are steel, then the eye bolts can be welded to the column or can be tied to the column by suitable cables. The means for securing the cable supports 5, 6, 7 are not shown in the drawings.

If desired, the cables 2, 3, 4 can be maintained taut by means of turnbuckles (not shown) or by other suitable means. It is presently preferred to use airplane cable of ¼-inch diameter as cables 2, 3 and 4, but other sizes and types of cables can be used so long as the assembly 1 as a whole has a strength sufficient to meet the OSHA requirements.

Figure 7:
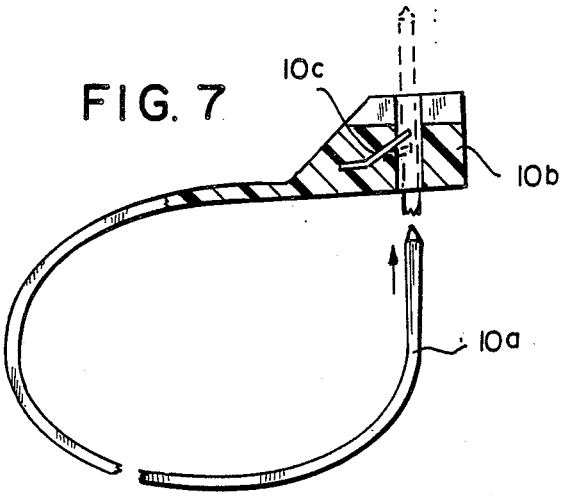
FIG. 7 is a view in section taken along lines 7—7 in FIG. 6.

Supported vertically by the cables 2, 3, 4 is a sheet 8 having a top edge 8*a* and a bottom edge 8*b*. (FIG. 2) As best seen in FIG. 2, the sheet 8 is provided with pairs of vertically spaced apart apertures 9 that extend longitudinally across the sheet 8 to provide three horizontal rows of apertures 9, each row being located adjacent cables 2, 3 and 4, respectively. As most clearly seen in FIG. 2, rapid-assembly electrical ties 10 secure the cables 2, 3, 4 to the sheet 8 by means of the tongue or strap 10*a*, which extends from the locking head 10*b*, through the apertures 9 and around the respective cable 2, 3, 4 and thence through the locking head 10*b*, which contains a pawl 10*c* (FIG. 7) that permits the tongue or strap 10*a* to enter and pass through the locking head 10*b* but prevents the tongue or strap 10*a* from being pulled out of the locking head 10*b*.

The upper cable 2 is preferably located from about 55 to about 65 inches from the building floor F, most preferably about 60 inches, while the intermediate cable 3 is preferably located from about 35 to about 45 inches from the building floor F, most preferably about 42 inches to conform to the current OSHA requirements. It is a significant feature of the present invention that the lower cable 4 is located only a few inches above the building floor F, such as up to about 5 inches, usually no more than about 2 inches, from the building floor F.

The arcuate bottom portion 8*c* of sheet 8 is secured to the lower cable 4 (FIG. 1) whereas the main body portion 8*d* of sheet 8 is secured to cables 2 and 3, the main body portion 8*d* extending from the edge 8*a* toward and being integral with the bottom portion 8*c*. As is readily seen, the arcuate bottom portion 8*c* lies on but is unsecured to the building floor F with the edge 8*b* positioned inwardly of the lower cable 4. With the stiff bottom portion 8*c* secured to the cable 4 only a short distance above the building floor F, and with edge 8*b* located on the building floor F inwardly of cable 4, the result is that the bottom portion 8*c* is sufficiently stiff to prevent objects from sliding off the building floor F under the lower cable 4. Indeed, the combination of the bottom portion 8*c* (which extends from the edge 8*b* to a point slightly above the lower cable 4) and its attachment to the lower cable 4 results in a stiff bottom portion 8*c* that provides a reliable barrier against objects from sliding off the floor. Preferably, the stiff bottom portion 8*c*, depending upon the nature and thickness of the material chosen, actually acts as a spring biased inwardly of the building floor, so that objects coming in contact with the stiff bottom portion 8*c* will be resiliently urged back onto the floor by the "rebound effect" of an object striking the spring-like stiff bottom portion 8*c*.

Sheet 8 is preferably of plastic, but may be of any other strong sheet material, such as canvas, leather, wood, metal or the like. The sheet 8 may be imperforate, but preferably includes apertures therein (not shown) to allow the wind to pass through. Preferably, the elongated sheet 8 will be made of polyethylene, polypropylene, etc., and generally will be of a thickness of from about 0.020 to about 0.100 inches. If the thickness for a given material is too small, then the strength of the resulting safety barrier assembly could be less than the requirement imposed by OSHA that the safety barrier assembly be capable of withstanding a load of at least 200 pounds applied in any direction with a minimum of deflection. On the other hand, if the thickness of the elongated sheet 8 becomes too great, then the economics of the assembly are adversely affected When the thickness of the elongated sheet 8 is extremely large, then it will be difficult to handle and erect the safety barrier assembly of the invention. Further, extremely large cables 2, 3, 4 will be required to support the extra weight of the unnecessarily heavy sheet 8. As a practical matter, it is presently contemplated that the practical maximum thickness for sheet 8 will be from about 0.050 to 0.060 inches.

Figure 8:
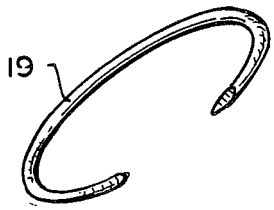
FIG. 8 is a perspective view of an attaching ring used in the invention.
Figure 6:
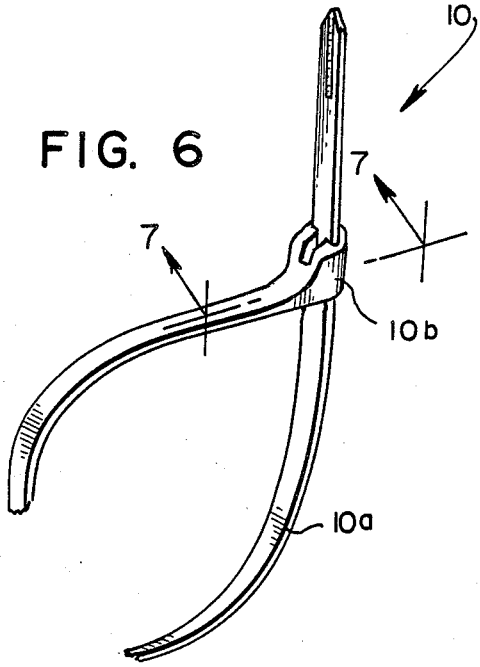
FIG. 6 is a perspective view of a rapid-assembly tie used in the invention.

A presently preferred embodiment of the invention is shown in FIG. 3, wherein an elongated sheet 18 is suspended from cables 2 and 3, the main body portion 18*d* being in the form of a plastic net, such as a polyethylene or polypropylene net, while the stiff bottom portion 8*c*, as installed, is in the form of an arcuate plastic sheet, such as an L-shaped plastic sheet. Connecting the main body portion 18*d* to the stiff bottom portion 18*c* are longitudinally spaced apart rings 19 having sharply pointed ends. Rings 19 (FIG. 8) may be conventional hog rings, which are provided in the form of open rings that are closed through the members 18*c*, 18*d* by means of a conventional hog ring tool. Plastic nets are commercially available that will permit the building assembly 1 to obtain the 200 pound strength referred to above, and such may be used in this invention. The stiff bottom portion or toeboard 18*c* has a vertical leg tall enough to clear the lower cable 4, while the horizontal arm is any convenient length to enable the stiff bottom portion or toeboard 18*c* to lie on the building floor F and to be easily and conveniently lifted up (after the ties 10 connecting the member 18C to cable 4 are removed or after cables 4 are detached from cable supports 7) thereby to expose the space between the building floor F and the lower cable 4. The stiff bottom portion 18*c* can be of the same material with the same dimensions and thickness as referred to above for sheet 8. The bottom portion 18*c* may be supplied flat and then bent to the desired arcuate shape when installed.

Figure 4:
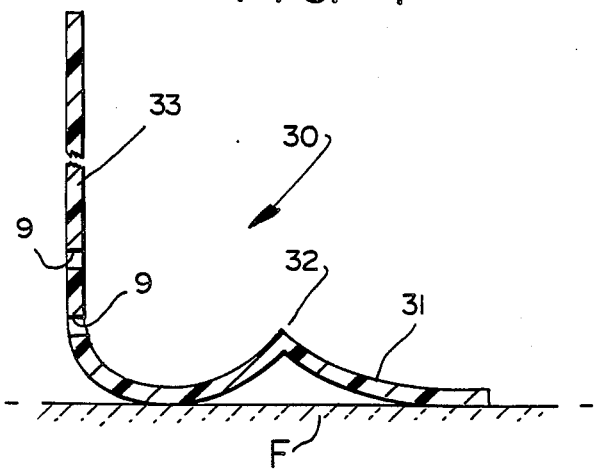
FIG. 4 is a detailed view of another embodiment of the toeboard used in the present invention.

A further embodiment of the toeboard is shown in FIG. 4, in which the toeboard 30 is also generally L-shaped, but the horizontal arm 31 has a portion 32 raised above the building floor F, the portion 32 being intermediate the free end of the horizontal arm 31 and the vertical leg 33. Again, the same materials and dimensioning can be used for the toeboard 30 as discussed above.

FIG. 5 illustrates a toeboard 40 that has a cross-section in the form of an inverted T or an inverted Y. In this case, the vertical leg 41 is secured to the lower cable 4, the horizontal arm 42 extends inwardly from the lower cable 2 and lies unsecured on the building floor F, whereas the other horizontal arm 43 extends outwardly from the lower cable 2 and also lies unsecured on the building floor F.

The inverted Y-shaped or inverted T-shaped toeboard 40 is desirable because it can be placed on the floor in the standing position before being attached to lower cable 4, which will simplify and expedite its installation.

While it is preferred that the toeboards 18*c* (FIG. 3), 30 (FIG. 4) and 40 (FIG. 5) will be used together with the elongated sheet 8 to provide the barrier assembly of the present invention, nevertheless these toeboards in combination with a lower cable 4 spaced only a few inches from the building floor F have significant advantages in and of themselves so that they can be used in place of the conventional toeboards that are fastened to the building floor. Thus, the toeboards of FIGS. 3–5 can be readily removed from the lower cable 4, simply by snipping the electrical tie 10 or detaching cable 4 from cable supports 7 to permit access to the space beneath the cable 4 and then quickly reattached. This is not as easily accomplished with conventional toeboards, which are generally planks of wood that are secured by fasteners driven into or otherwise secured to the building floor F. Moreover, when conventional toeboards are removed after they have served their purpose, a considerable amount of labor is necessary to remove all of the fasteners along the length of the toeboard. In contrast, after the toeboards shown in FIGS. 3–5 are removed from cable 4, the cable 4 is quickly detached from its two points of attachment to the columns A.

It is presently contemplated that the safety barrier assembly of the present invention will find its greatest utility in protecting open-sided floors of a building under construction, where the span between adjacent columns A may be 20–30 feet or more. Accordingly, it is presently contemplated to provide the sheet 8 in the form of rolls containing about 50 feet or more of the plastic sheet material Likewise, where separate main body portions and bottom portions are employed, these too would be supplied in lengths of about 50 feet or more.

I claim:

1. A safety barrier assembly for a floor of a building under construction, which comprises cable support means;

upper and lower cables supported substantially horizontally by said cable support means along at least a portion of the outer perimeter of the building floor, said lower cable being only a few inches above the building floor; and elongated sheet means having opposed longitudinally extending first and second edges, a main body portion extending from said first edge toward said second edge and a stiff longitudinally extending bottom portion extending from said main body portion toward and terminating in said second edge;

said sheet means being supported vertically by said cables with said main body portion being secured to said upper cable and said stiff bottom portion being secured to said lower cable;

said stiff bottom portion lying on but being unsecured to said building floor with said second edge positioned inwardly of said lower cable; and said assembly having a strength sufficient to withstand a load of 200 pounds applied in any direction with a minimum of deflection.

2. The safety barrier according to claim 1, wherein said main body portion and said stiff bottom portion are plastic.

3. The safety barrier according to claim 1, wherein said main body portion is integral with said stiff bottom portion of said sheet means.

4. The safety barrier according to claim 1, wherein said main body portion is a plastic net.

5. The safety barrier according to claim 1, wherein said main body portion is a net secured to said stiff bottom portion.

6. The safety barrier according to claim 1, wherein said stiff bottom portion has an inverted T-shaped cross-section, the vertical leg of which is secured to said lower cable while the generally horizontal arms thereof contact but are unsecured to said building floor.

7. The safety barrier according to claim 1, wherein said stiff bottom portion has an arcuate cross-section.

8. The safety barrier according to claim 1, wherein said stiff bottom portion has a generally inverted Y-shaped cross-section, the vertical leg of which is secured to said lower cable while the generally horizontal arms thereof contact but are unsecured to said building floor.

9. The safety barrier according to claim 1, wherein said stiff bottom portion has a generally L-shaped cross-section, the vertical leg of which is secured to said lower cable while the horizontal arm thereof contacts but is unsecured to said building floor.

10. The safety barrier according to claim 9, wherein said horizontal arm has a portion thereof intermediate its ends raised above the building floor.

11. A safety barrier assembly for a floor of a building under construction, which comprises cable support means;

upper and lower cables supported substantially horizontally by said cable support means along at least a portion of the outer perimeter of the building floor, and an intermediate cable horizontally supported by said cable support means between said upper and lower cables, said lower cable being only a few inches above the building floor; and elongated sheet means having opposed longitudinally extending first and second edges, a main body portion extending from said first edge toward said second edge and a stiff longitudinally extending bottom portion extending from said main body portion toward and terminating in said second edge;

said sheet means being supported vertically by said cables with said main body portion being secured to said intermediate and upper cables and said stiff bottom portion being secured to said lower cable; said stiff bottom portion lying on but unsecured to said building floor with said second edge positioned inwardly of said lower cable; and said assembly having a strength sufficient to withstand a load of 200 pounds applied in any direction with a minimum of deflection.

12. The safety barrier according to claim 11, wherein the lower cable is from about 2 to about 5 inches from the building floor, the intermediate cable is from about 35 to about 45 inches from the building floor and the upper cable is about 55 to about 65 inches from the building floor.

13. The safety barrier according to claim 12, wherein said upper cable is about 60 inches from the floor, the intermediate cable is about 42 inches from the floor and the lower cable is about 2 inches from the floor.

14. The safety barrier according to claim 11, wherein said main body portion and said stiff bottom portion are plastic.

15. The safety barrier according to claim 11, wherein said main body portion is integral with said stiff bottom portion of said sheet means.

16. The safety barrier according to claim 11, wherein said stiff bottom portion is arcuate.

17. The safety barrier according to claim 11, wherein said main body portion is a net secured to said stiff bottom portion.

18. The safety barrier according to claim 11, wherein said main body portion is a plastic net secured to said stiff bottom portion.

19. A toeboard assembly for a floor of a building under construction, which comprises cable support means, a cable supported substantially horizontally by said cable support means along at least a portion of the outer perimeter of the building floor, said cable being only a few inches above the building floor, and an elongated stiff sheet secured to said lower cable adjacent a first longitudinally extending edge of said sheet with the second longitudinally extending edge of said sheet positioned inwardly of said lower cable, said stiff sheet lying on but being unsecured to said building floor.

20. The toeboard according to claim 19, wherein said stiff sheet has a generally inverted T-shaped cross-section, the vertical leg of which is secured to said lower cable while th generally horizontal arms thereof contact but are unsecured to said building floor.

21. The toeboard according to claim 19, wherein said stiff sheet has a generally inverted Y-shaped cross-section, the vertical leg of which is secured to said lower cable while the generally horizontal arms thereof contact but are unsecured to said building floor.

22. The toeboard according to claim 19, wherein said stiff sheet has a generally L-shaped cross-section, the vertical leg of which is secured to said lower cable while the horizontal arm thereof contacts but is unsecured to said building floor.

23. The toeboard according to claim 22, wherein said horizontal arm has a portion thereof intermediate its ends raised above the building floor.

24. The toeboard according to claim 19, including a longitudinally extending row of pairs of vertically spaced apart apertures.

25. A safety barrier assembly for a floor of a building under construction, which comprises cable support means;

upper and lower cables supported substantially horizontally by said cable support means along at least a portion of the outer perimeter of the building floor, said lower cable being only a few inches above the building floor; and elongated sheet means having opposed longitudinally extending first and second edges, a main body portion extending from said first edge toward said second edge and a longitudinally extending bottom portion extending from said main body portion toward and terminating in said second edge;

said sheet means being supported vertically by said cables with said main body portion being secured to said upper cable and said bottom portion being secured to said lower cable;

said bottom portion lying on but being unsecured to said building floor with said second edge positioned inwardly of said lower cable;

said bottom portion of said sheet means and said lower cable together forming a toeboard means for preventing materials from falling off the building; and said assembly having a strength sufficient to withstand a load of 200 pounds applied in any direction with a minimum of deflection.

26. The safety barrier according to claim 25, wherein an intermediate cable is horizontally supported by said cable support means between said upper and lower cables.

* * * * *